US008598773B2

(12) United States Patent
Corazza et al.

(10) Patent No.: US 8,598,773 B2
(45) Date of Patent: Dec. 3, 2013

(54) HOT CATHODE FLUORESCENT LAMP CONTAINING A DEVICE FOR MERCURY RELEASE AND A GETTER

(75) Inventors: Alessio Corazza, Como-Camnago Volta (IT); Vincenzo Massaro, Albairate (IT); Mauro Riva, Cantello (IT)

(73) Assignee: SAES Getters S.p.A., Lainate (IT)

( * ) Notice: Subject to any disclaimer, the term of this patent is extended or adjusted under 35 U.S.C. 154(b) by 0 days.

(21) Appl. No.: 12/993,833

(22) PCT Filed: Jun. 18, 2009

(86) PCT No.: PCT/EP2009/057630

§ 371 (c)(1), (2), (4) Date: Nov. 19, 2010

(87) PCT Pub. No.: WO2009/156334

PCT Pub. Date: Dec. 30, 2009

(65) Prior Publication Data

US 2011/0074278 A1 Mar. 31, 2011

(30) Foreign Application Priority Data

Jun. 25, 2008 (IT) ..... RM2008A0334

(51) Int. Cl.
*H01J 1/62* (2006.01)
*H01J 63/04* (2006.01)

(52) U.S. Cl.
USPC ..... 313/490; 313/492; 313/629

(58) Field of Classification Search
USPC ..... 313/490, 492, 565, 629, 613, 639, 642, 313/240, 38
See application file for complete search history.

(56) References Cited

U.S. PATENT DOCUMENTS

| | | | | | |
|---|---|---|---|---|---|
| 2,244,070 | A | * | 6/1941 | Kurtz | 313/617 |
| 3,013,169 | A | * | 12/1961 | Bitter et al. | 313/42 |
| 3,215,882 | A | * | 11/1965 | Toomey | 313/490 |
| 3,722,976 | A | * | 3/1973 | Porta et al. | 445/9 |
| 3,764,842 | A | * | 10/1973 | Ridders et al. | 313/546 |
| 3,794,402 | A | * | 2/1974 | Ridders et al. | 445/19 |
| 5,006,755 | A | | 4/1991 | Wittmann et al. | |
| 5,801,482 | A | * | 9/1998 | Verhaar et al. | 313/483 |
| 6,304,029 | B1 | * | 10/2001 | De Bot et al. | 313/493 |

(Continued)

FOREIGN PATENT DOCUMENTS

| | | |
|---|---|---|
| EP | 085969 | 8/1983 |
| EP | 788142 | 8/1997 |

(Continued)

OTHER PUBLICATIONS

Machine English Language Translation of Toda JP 2002-289132.*

(Continued)

*Primary Examiner* — Mariceli Santiago
*Assistant Examiner* — Glenn Zimmerman
(74) *Attorney, Agent, or Firm* — Steinfl & Bruno LLP

(57) ABSTRACT

A hot cathode fluorescent lamp (10) of small diameter is described comprising a shield (17) around the cathode (15) to avoid the formation of blackenings on the phosphors due to evaporated material and a mercury filiform mercury dispenser (20) fixed by a metallic part (18) to the front part of the shield, in such a geometry that said dispenser is turned towards the opposite end of the lamp and its axis is essentially parallel to the axis of the lamp.

13 Claims, 2 Drawing Sheets

(56) References Cited

U.S. PATENT DOCUMENTS

| | | | | |
|---|---|---|---|---|
| 6,472,812 | B2 * | 10/2002 | Vose et al. | 313/486 |
| 6,538,372 | B2 * | 3/2003 | Vose et al. | 313/486 |
| 6,680,571 | B1 * | 1/2004 | Giorgi et al. | 313/565 |
| 7,990,041 | B2 * | 8/2011 | Carter et al. | 313/490 |
| 7,999,470 | B2 * | 8/2011 | Snijkers-Hendrickx et al. | 313/577 |
| 2008/0197776 | A1 * | 8/2008 | Nozaki | 313/629 |
| 2008/0284306 | A1 * | 11/2008 | Hildenbrand et al. | 313/487 |

FOREIGN PATENT DOCUMENTS

| | | | |
|---|---|---|---|
| EP | 806053 | | 4/2000 |
| EP | 981826 | | 11/2003 |
| EP | 1179216 | | 12/2005 |
| GB | 1440025 | | 6/1976 |
| JP | 54 092684 | | 7/1979 |
| JP | 2002289132 | A * | 10/2002 |
| WO | 2006/008771 | | 1/2006 |
| WO | 2006/067718 | | 6/2006 |

OTHER PUBLICATIONS

PCT International Search Report for PCT/EP2009/057630 filed on Jun. 18, 2009 in the name of Saes Getters S.P.A.

PCT Written Opinion for PCT/EP2009/057630 filed on Jun. 18, 2009 in the name of Saes Getters S.P.A.

* cited by examiner

HOT CATHODE FLUORESCENT LAMP CONTAINING A DEVICE FOR MERCURY RELEASE AND A GETTER

CROSS REFERENCE TO RELATED APPLICATIONS

The present application is the U.S. national stage of International Application PCT/EP2009/057630 filed on Jun. 18, 2009 which, in turn, claims priority to Italian Patent Application RM2008A000334 filed on Jun. 25, 2008.

The present invention refers to a hot cathode fluorescent lamp containing a device for mercury release and a getter.

Hot cathode fluorescent lamps are known in the field by the acronym HCFL (Hot Cathode Fluorescent Lamp), which will be used in the remaining description. These lamps are commonly used in ambient lighting.

A HCFL consists of a glass tube filled with a suitable gaseous mixture (generally of argon and neon or just argon) in which there are few milligrams of mercury; at both ends of the tube there are the two cathodes necessary to trigger and maintain the electric discharge in the gas, which is the origin of the light emission of the lamp; this emission occurs because the mercury atoms, in the conditions which are established when the lamp is on, emit ultraviolet radiation which is converted into visible light by materials (so-called phosphors) which coat the inside of the wall of the glass tube. Generally the two cathodes are in the form of a metallic filament (e.g. tungsten), which may be linear but more commonly is shaped, for example has the shape of a helical spiral, in order to increase its length. The filament is coated with a mixture of alkaline earth metal oxides (essentially barium, calcium and strontium oxides) which improve the electron emission characteristics of the filament and therefore help the discharge starting and reduce the energy consumption of the lamp.

For the lamp turning on, the cathodes of the HCFL are pre-heated such as to favour the emission of electrons due to thermionic effect and therefore make easier the triggering of the discharge; when lamp has been switched on, the cathodes work with a hot point, called hot spot, which reaches a temperature greater than 700° C. The coating of the filament with the oxide mixture is obtained by covering the filament with a mixture of barium, calcium and strontium carbonate, and causing the thermal decomposition of these to give the corresponding oxides (by heating the filament by means of flowing electric current therethrough); this operation must necessarily occur inside the lamp, during the final steps of the lamp production, because due to the high chemical reactivity of said oxides with some atmospheric gases, it is not possible to separately manufacture a filament already coated with metal oxides and to then insert it into the lamp. The decomposition from carbonates to oxides requires a temperature of about 1200° C.

As mentioned above, for the operation of the lamp it is necessary that the gaseous mixture contained therein comprises some milligrams of mercury; further in order to ensure good performance and lifetime of the lamp, it is necessary to have therein a getter material, i.e. a material capable of reacting with and fixing chemically the traces of gaseous impurities present in the atmosphere of the lamp, which could change its operational parameters.

Various methods are known for the introduction of mercury into the lamp. For example, the dripping of liquid mercury may be used, which however involves problems in reproducing the dosage of small quantities of the metal, as well as pollution of the working environment; porous tablets (of sintered ceramic or metal) impregnated with mercury may be used, which however have the same drawbacks as the previous method; mercury amalgams may be used (for example based on zinc, indium, bismuth or their mixtures), which however have the disadvantage of releasing mercury during the manufacturing operations of the lamp when this is not yet sealed, resulting in leakage of the element into the working environment; or even glass vials containing liquid mercury may be used, which then can be broken after the sealing of the lamp by localized heating, but which have the disadvantage of requiring a complex construction and a complex positioning in the lamp.

In the past the Applicant has developed methods for mercury release in alternative to those seen before, which are based on the use of intermetallic compounds of mercury with titanium and/or zirconium, and in particular the compound $Ti_3Hg$ sold under the name St 505. This compound has the advantage of not releasing mercury up to about 500° C., and thus is capable of undergo the thermal treatments during manufacturing of the lamp without loss of the element, which is released by an activation treatment (from the outside by electromagnetic induction) at a temperature comprised between 800 and 900° C., only once the lamp is closed. More recently the Applicant has introduced into the market for the same aim a material based on a titanium-copper-chrome-mercury composition, disclosed in the international patent application WO 2006/008771 A1 and sold under the name St 545.

These materials can be used in the lamps in the form of powders rolled onto a metallic strip, for example ring-shaped to form the cathode shield, as shown in the patent EP 806053 B1, or inserted into a metallic container of a suitable shape, as described in the patent EP 981826 B1.

The getter materials useful for the operation of the lamps can be a metal selected from zirconium, titanium, vanadium, niobium, hafnium or tantalum, or an alloy of these elements (in particular zirconium or titanium) with one ore more elements selected from the transition elements, the rare earth metals or aluminum. The getter materials most commonly used in the lamps are a zirconium-aluminum alloy containing about 84 wt % of zirconium, and a zirconium-cobalt-rare earth alloy containing about 80 wt % of zirconium, 15% of cobalt and 5% of rare earths. The documents EP 806053 B1 and EP 981826 B1 describe the presence of a getter material together with the mercury compound on the shield or in the container.

Recently the use of HCFL in backlight units of LCD displays of large size (larger than 50 inches) instead of cold cathode lamps (CCFL) traditionally used for this purpose, has been studied. The advantage expected by the use of HCFL instead of CCFL is a better light yield. In order to be used for the backlight of LCD displays, these lamps must have a restrained diameter that is typically comprised between 4 and 6 mm.

In view of the high temperatures reached by the cathode, both during the operation of carbonate conversion and during the life of the lamp, the cathode in hot cathode fluorescent lamps is generally shielded with a metallic element, which avoids material evaporation or sputtering from the filament. In fact, deposited material on the walls of the lamp, coated with phosphors, thus produces blackish areas, beauty flaws or unaestheticism and zones of the lamp with a lower light emission; this element generally has the shape of a cylindrical shield which surrounds the cathode.

The solution described in EP 806053 B1, suitable for the traditional lamps of a diameter of 2.54 cm (so-called "T8" lamps), cannot be used in lamps with a diameter of few millimetres, because the operation of curving the metallic strip to form the shield, due to the small requested curving radiuses, would detach the powders held on it.

EP 981826 B1 describes, apart from various geometries of mercury dispensers, also a method of using filiform dispensers (so-called wire dispensers), suitable for being used in the manufacturing process of lamps of small diameter. The method consists in sealing the lamp with a dispenser on one of its ends, causing the releasing of mercury in the lamp, and then performing a second sealing of the glass tube of the lamp at such a position to exclude the exhausted dispenser, which thus does not remain in the finished lamp. This method is effective and widely used, but involves a relative complex process, which the manufacturers of HCFL would prefer to avoid.

Object of the present invention is that of providing a hot cathode fluorescent lamp having a small diameter and containing a device for mercury release and a getter.

This object is achieved according to the present invention with a hot cathode fluorescent lamp formed of a glass tube, internally coated with phosphors, having two ends, each one closed by an end part and filled with a suitable gaseous atmosphere, with a cathode in proximity to each of said ends and comprising a cylindrical metallic shield around each cathode, characterized in that on at least one shield a filiform mercury dispenser is fixed, by means of a metallic part (18), in such a geometry that said dispenser is turned towards the opposite end of the lamp and its axis is essentially parallel to the axis of the lamp.

In the present description and in the claims, with filiform dispenser it is intended a dispenser having an elongated structure, meaning that the ratio between its length and the lateral dimension is greater than 2 and this lateral dimension is equal or less than 1.5 mm. In the case of complex cross-section (as for example a trapezoidal one) the ratio refers to the widest lateral dimension.

The invention will be further described in the following with reference to the drawings, in which.

Figure 1:
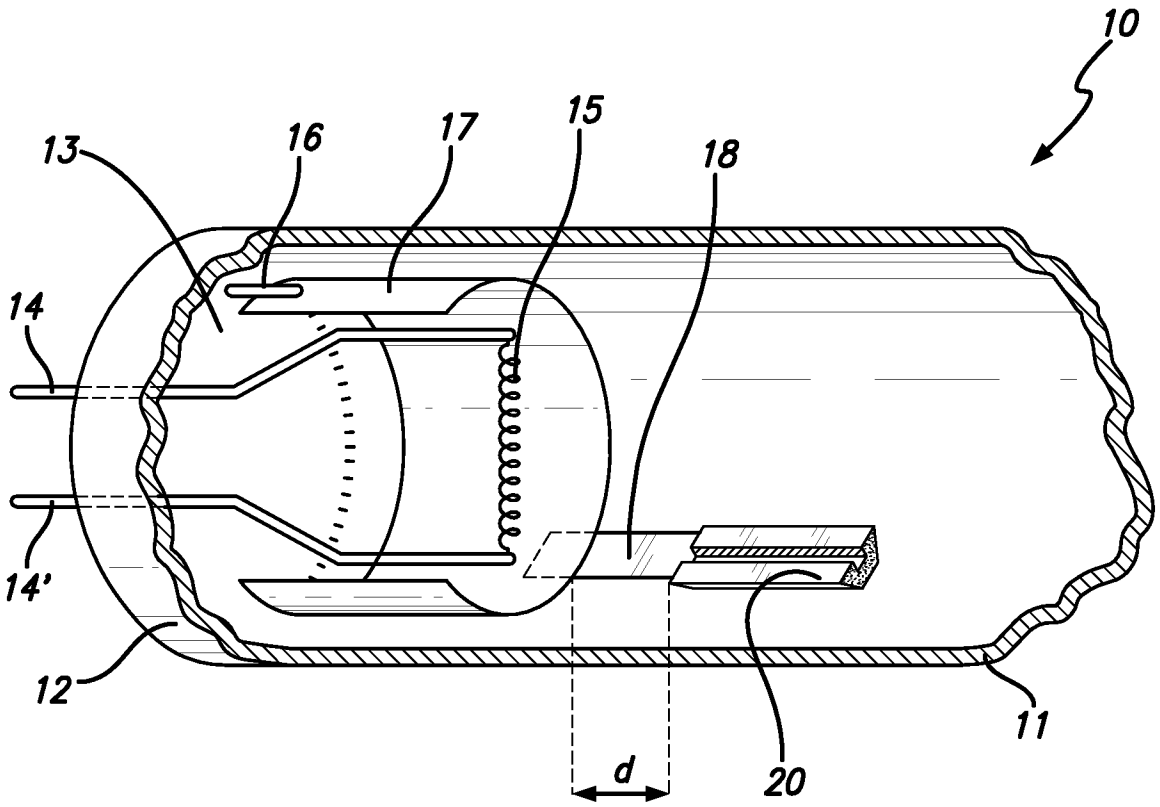
FIG. 1 shows a prospective, broken view of one of the ends of the lamp according to the invention.

In the figures the dimensions of the various elements and their relationship may not be corresponding to the real ones but have been intentionally altered in order to improve the figure readability.

The lamp, 10, comprises the glass tube 11 closed at its end 12 by an end part 13, usually of glass; in this part two supports, 14 and 14', of the cathode 15 are fixed; for reasons of simplicity of representation the cathode is shown in the drawing as a simple spiral-shaped filament connected to the two ends of the supports 14 and 14', but as previously said it could also have more complex shapes, for example a more extended helical spiral having an axis that coincides with the axis of the lamp and a height about equal to that of the shield. Also a third support 16 is fixed to the flat part 13, that is electrically isolated from those 14 and 14' and from the outside, which has the only function of keeping in position a metallic shield 17, generally having the geometry of a cylinder with the two bases open, with the axis essentially coincident with that of the lamp, and of such a height to completely shield the cathode in the direction perpendicular to the axis of the lamp. The two supports 14 and 14' are feed-throughs with respect to the part 13 (directly or as being connected through this part to two external electrical conductors) for the electricity supply of the cathode. In alternative the shield may be fixed, without the necessity of the third support 16, to one of the two supports 14 and 14', in such a way that this does not touch neither the second support nor the filament. At the end of shield 17 that faces the centre of the lamp a metallic part 18 is fixed, for example by means of welding spots, which may be in form of a wire or preferably a strip (in the drawing the latter one is exemplified). At the end of the wire or strip opposite to the shield 17 a filiform mercury dispenser 20 is fixed, for example by means of welding points. As an alternative the filiform dispenser may be fixed so that the metallic part 18 acting as support completely or partially overlaps the dispenser length. As mentioned above, the dispenser 20 is essentially parallel to the axis of the lamp, with the meaning that it is parallel or only slightly inclined with respect to this latter. In particular the angle between the axis of the lamp and the filiform dispenser shall be less than 20° . As a particular embodiment of the invention, that is especially useful with smallest diameter, the above described angle shall be comprise between 20 and 10° in order to completely avoid possible undesired shadow effect. In the drawing a dispenser of the type described in EP 981826 B1 is shown, with a trapezoidal cross-section, but other shapes are possible, in particular other cross-sections compatible with the dimensional constrains of the lamp according to the invention may have squared or circular shape. An alternative useful dispenser type, for example, is described in EP 1179216 B1, wherein the dispenser material is contained inside a metal tube with open ends and reduced cross-section.

Figure 2:
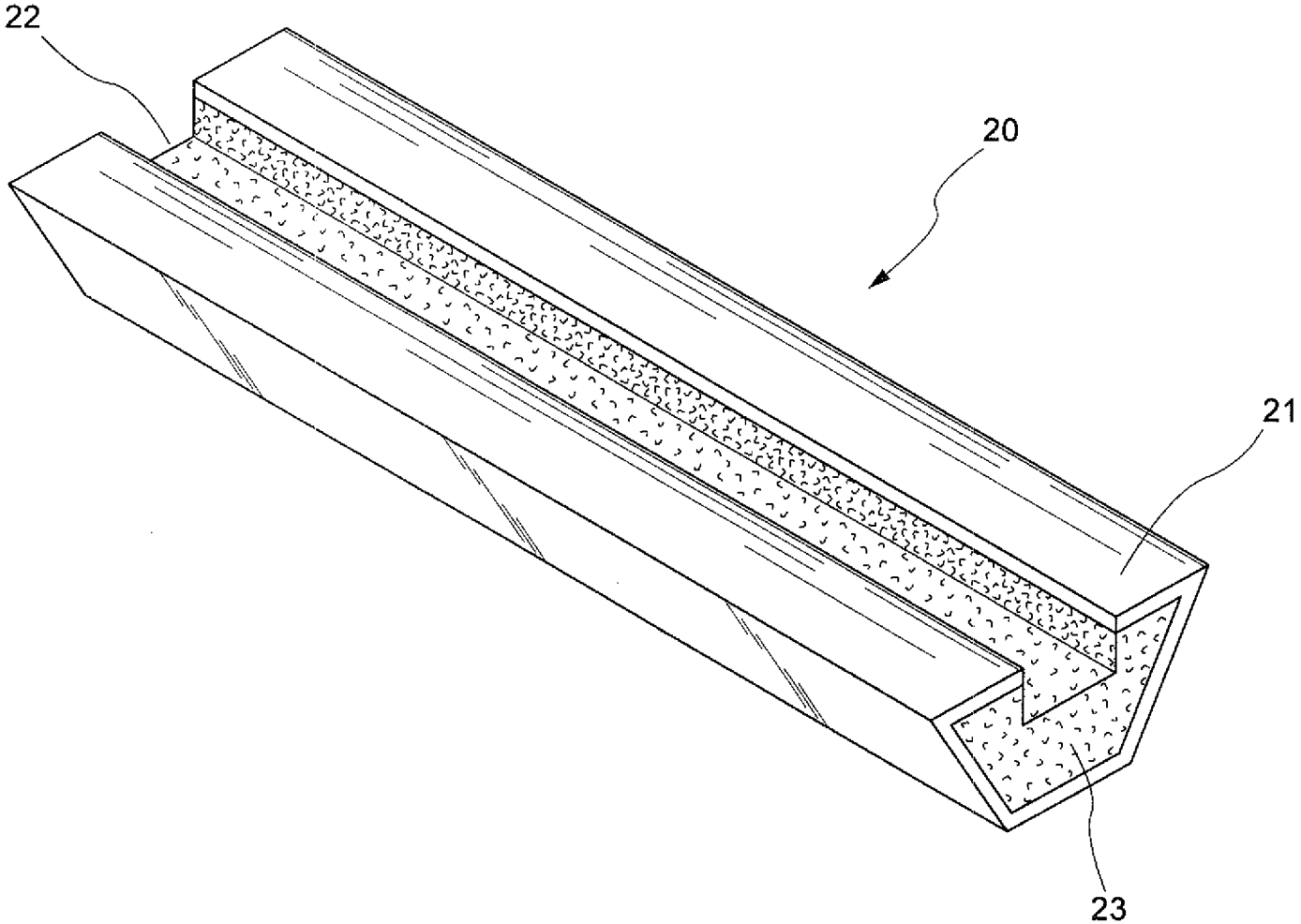
FIG. 2 shows a preferred embodiment of mercury dispenser for use in a lamp according to the invention.

FIG. 2 shows more in detail the mercury dispenser 20, the container 21 of which is formed by a metallic strip, generally carried out in nickel plated iron, bent to form a trapezoidal cross-section with a slit 22 on the upper side, and inside which there is a mixture 23 formed of powders of a material capable of releasing mercury when heated and of a getter material, in a weight ratio between 9:1 and 4:6; the preferred materials are St 505 or St 545 for mercury release, and a zirconium-aluminum alloy containing about 84 wt % of zirconium, sold by the Applicant under the name St 101 as getter material. The typical dimensions of this dispenser are about 1.0-1.2 mm, for the largest side of the trapezoid, and about 0.8-1.0 mm for the height, and a length comprised between about 2 and 10 mm, preferably between about 4 and 8 mm, depending on the required mercury quantity in a specific lamp.

The inventors have found that the distance between the shield 17 and the dispenser 20, measured at the position of maximum closeness (indicated by d in FIG. 1), must not be smaller than 1 millimeter; this is to avoid excessive overheating of the dispenser during the treatment for converting the barium, calcium and strontium carbonates to their oxides; should this happen, it could result in early emission of mercury which would be lost, because this operation is carried out under a gas stream and during pumping when the lamp is not yet closed. Vice versa, the maximum value of this distance is not critical for the operation of the dispenser, but although it is preferred that it is not too large, to prevent that the dispenser "extends" too much inside the lamp, which could give rise to bothersome shadow effects in the lamp; the inventors have found that an advisable maximum distance is about 5 mm.

The invention claimed is:

1. A hot cathode fluorescent lamp formed by a glass tube, comprising:

two tube ends, each tube end closed by a tube end portion, the glass tube being internally coated with phosphors and filled with a gaseous atmosphere, a cathode in proximity of each tube end, a cylindrical metallic shield disposed around each cathode, each cylindrical metallic shield comprising a first shield end facing the tube end that is closest to the cathode that the shield is disposed around and a second shield end opposite the first shield end, and at least one mercury dispenser fixedly connected with a respective second shield end through a metallic part, wherein the at least one mercury dispenser has a dispenser axis essentially parallel to an axis of the lamp and is arranged between the second shield end and the tube end facing the second shield end.

2. The lamp of claim 1, wherein each cathode is connected to support end portions of two supports, the two supports being feed-throughs between an inner environment and an outside environment of the glass tube through the tube end proximal to said each cathode, and each shield is supported by a first one of said two supports and is electrically isolated from the second one of said two supports and from the cathode around which said each shield is disposed.

3. The lamp of claim 2, wherein said each shield is further supported by a third support, said third support being fixed to the tube end in proximity of the cathode around which said each shield is disposed, said third support being electrically isolated from the two supports and the outside environment.

4. The lamp of claim 1, wherein the metallic part is a wire-shaped or strip-shaped metallic part.

5. The lamp of claim 1, wherein the mercury dispenser has a trapezoidal cross section and comprises a slit along a total length of a side of the dispenser corresponding to the largest side of the trapezoid.

6. The lamp of claim 1, wherein the mercury dispenser contains a getter material and a mixture of powders of a material capable of releasing mercury due to heating.

7. The lamp of claim 6, wherein a weight ratio between the material capable of releasing mercury and the getter material is between 9:1 and 4:6.

8. The lamp of claim 1, wherein a minimum distance between the dispenser and the shield connected with the dispenser is between 1 and 5 mm.

9. The lamp of claim 1, wherein the dispenser axis and the axis of the lamp form an angle equal to or less than 20 degrees.

10. The lamp of claim 9, wherein the angle is between 10 degrees and 20 degrees.

11. The lamp of claim 1 wherein:

an elongation axis of the metallic part and the mercury dispenser axis are in the same direction.

12. The lamp according to claim 1, wherein a ratio between the length and lateral dimension of the mercury dispenser is greater than 2.

13. The lamp according to claim 12, wherein the lateral dimension of the mercury dispenser is equal or less than 1.5 mm.

* * * * *